US009188012B2

(12) United States Patent
Lacy et al.

(10) Patent No.: US 9,188,012 B2
(45) Date of Patent: Nov. 17, 2015

(54) COOLING STRUCTURES IN THE TIPS OF TURBINE ROTOR BLADES

(75) Inventors: Benjamin Paul Lacy, Greer, SC (US); Brian Peter Arness, Greenville, SC (US); Xiuzhang James Zhang, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 715 days.

(21) Appl. No.: 13/479,663

(22) Filed: May 24, 2012

(65) Prior Publication Data

US 2013/0315748 A1 Nov. 28, 2013

(51) Int. Cl.
*F01D 5/18* (2006.01)
*F01D 5/20* (2006.01)

(52) U.S. Cl.
CPC *F01D 5/20* (2013.01); *F01D 5/186* (2013.01); *F05D 2260/204* (2013.01)

(58) Field of Classification Search
CPC .... F01D 5/186; F01D 25/12; F05D 2260/202
USPC ..... 415/115; 416/92, 97 R
See application file for complete search history.

(56) References Cited

U.S. PATENT DOCUMENTS

| | | | | |
|---|---|---|---|---|
| 4,487,550 | A | 12/1984 | Horvath et al. | |
| 5,660,523 | A | 8/1997 | Lee | |
| 6,461,107 | B1 | 10/2002 | Lee et al. | |
| 6,461,108 | B1 | 10/2002 | Lee et al. | |
| 6,528,118 | B2 | 3/2003 | Lee et al. | |
| 7,922,451 | B1 | 4/2011 | Liang | |
| 8,182,221 | B1 | 5/2012 | Liang | |
| 8,366,394 | B1 | 2/2013 | Liang | |
| 2002/0106457 | A1 | 8/2002 | Lee et al. | |
| 2003/0021684 | A1 * | 1/2003 | Downs et al. | 416/92 |
| 2004/0096690 | A1 * | 5/2004 | Kelly et al. | 428/632 |
| 2005/0232771 | A1 | 10/2005 | Harvey et al. | |
| 2005/0244270 | A1 | 11/2005 | Liang | |
| 2008/0298975 | A1 | 12/2008 | James et al. | |
| 2010/0111704 | A1 | 5/2010 | Hada | |
| 2010/0183427 | A1 | 7/2010 | Liang | |
| 2012/0201695 | A1 | 8/2012 | Little | |
| 2012/0282108 | A1 | 11/2012 | Lee et al. | |

FOREIGN PATENT DOCUMENTS

| | | | |
|---|---|---|---|
| DE | 19944923 | A1 | 3/2001 |
| EP | 1911934 | A1 | 4/2008 |
| EP | 2161412 | A2 | 3/2010 |
| EP | 2434097 | A1 | 3/2012 |
| EP | 2586981 | A2 | 5/2013 |
| EP | 2604796 | A2 | 6/2013 |

OTHER PUBLICATIONS

Search Report and Written Opinion from EP Application No. 13168387.2 dated Aug. 9, 2013.

* cited by examiner

*Primary Examiner* — Edward Look
*Assistant Examiner* — Danielle M Christensen
(74) *Attorney, Agent, or Firm* — Mark E. Henderson; Ernest G. Cusick; Frank A. Landgraff

(57) ABSTRACT

A turbine rotor blade used in a gas turbine engine, which includes an airfoil having a tip at an outer radial edge, is described. The airfoil includes a pressure sidewall and a suction sidewall that join together at a leading edge and a trailing edge of the airfoil, the pressure sidewall and the suction sidewall extending from a root to the tip. The tip includes a tip plate and, disposed along a periphery of the tip plate, a rail. The rail includes a microchannel connected to a coolant source.

21 Claims, 7 Drawing Sheets

COOLING STRUCTURES IN THE TIPS OF TURBINE ROTOR BLADES

BACKGROUND OF THE INVENTION

The present application is related to Ser. No. 13/479,710 and Ser. No. 13/479,683, filed concurrently herewith, which are fully incorporated by reference herein and made a part hereof.

The present application relates generally to apparatus, methods and/or systems for cooling the tips of gas turbine rotor blades. More specifically, but not by way of limitation, the present application relates to apparatus, methods and/or systems related to microchannel design and implementation in turbine blade tips.

In a gas turbine engine, it is well known that air is pressurized in a compressor and used to combust a fuel in a combustor to generate a flow of hot combustion gases, whereupon such gases flow downstream through one or more turbines so that energy can be extracted therefrom. In accordance with such a turbine, generally, rows of circumferentially spaced rotor blades extend radially outwardly from a supporting rotor disk. Each blade typically includes a dovetail that permits assembly and disassembly of the blade in a corresponding dovetail slot in the rotor disk, as well as an airfoil that extends radially outwardly from the dovetail.

The airfoil has a generally concave pressure side and generally convex suction side extending axially between corresponding leading and trailing edges and radially between a root and a tip. It will be understood that the blade tip is spaced closely to a radially outer turbine shroud for minimizing leakage therebetween of the combustion gases flowing downstream between the turbine blades. Maximum efficiency of the engine is obtained by minimizing the tip clearance or gap such that leakage is prevented, but this strategy is limited somewhat by the different thermal and mechanical expansion and contraction rates between the rotor blades and the turbine shroud and the motivation to avoid an undesirable scenario of having excessive tip rub against the shroud during operation.

In addition, because turbine blades are bathed in hot combustion gases, effective cooling is required for ensuring a useful part life. Typically, the blade airfoils are hollow and disposed in flow communication with the compressor so that a portion of pressurized air bled therefrom is received for use in cooling the airfoils. Airfoil cooling is quite sophisticated and may be employed using various forms of internal cooling channels and features, as well as cooling holes through the outer walls of the airfoil for discharging the cooling air. Nevertheless, airfoil tips are particularly difficult to cool since they are located directly adjacent to the turbine shroud and are heated by the hot combustion gases that flow through the tip gap. Accordingly, a portion of the air channeled inside the airfoil of the blade is typically discharged through the tip for the cooling thereof.

It will be appreciated that conventional blade tip design includes several different geometries and configurations that are meant to prevent leakage and increase cooling effectiveness. Exemplary patents include: U.S. Pat. No. 5,261,789 to Butts et al.; U.S. Pat. No. 6,179,556 to Bunker; U.S. Pat. No. 6,190,129 to Mayer et al.; and, U.S. Pat. No. 6,059,530 to Lee. Conventional blade tip designs, however, all have certain shortcomings, including a general failure to adequately reduce leakage and/or allow for efficient tip cooling that minimizes the use of efficiency-robbing compressor bypass air. In addition, as discussed in more detail below, conventional blade tip design, particularly those having a "squealer tip" design, have failed to take advantage of or effectively integrate the benefits of microchannel cooling. As a result, an improved turbine blade tip design that increases the overall effectiveness of the coolant directed to this region would be in great demand.

BRIEF DESCRIPTION OF THE INVENTION

According to one aspect of the invention, the present application describes a turbine rotor blade used in a gas turbine engine, which includes an airfoil having a tip at an outer radial edge. The airfoil includes a pressure sidewall and a suction sidewall that join together at a leading edge and a trailing edge of the airfoil, the pressure sidewall and the suction sidewall extending from a root to the tip. The tip includes a tip plate and, disposed along an periphery of the tip plate, a rail. The rail includes a microchannel connected to a coolant source.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
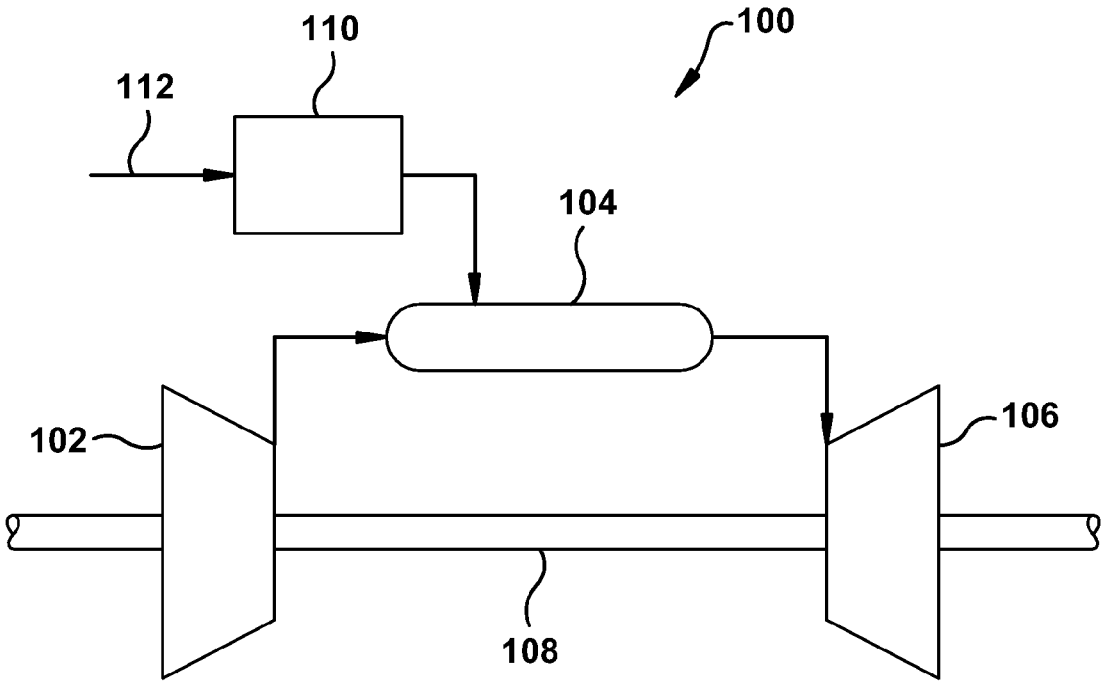
Figure 1 (Prior Art)
FIG. 1 is a schematic diagram of an embodiment of a turbomachine system.

FIG. 1 is a schematic diagram of an embodiment of a turbomachine system, such as a gas turbine system 100. The system 100 includes a compressor 102, a combustor 104, a turbine 106, a shaft 108 and a fuel nozzle 110. In an embodiment, the system 100 may include a plurality of compressors 102, combustors 104, turbines 106, shafts 108 and fuel nozzles 110. The compressor 102 and turbine 106 are coupled by the shaft 108. The shaft 108 may be a single shaft or a plurality of shaft segments coupled together to form shaft 108.

In an aspect, the combustor 104 uses liquid and/or gas fuel, such as natural gas or a hydrogen rich synthetic gas, to run the engine. For example, fuel nozzles 110 are in fluid communication with an air supply and a fuel supply 112. The fuel nozzles 110 create an air-fuel mixture, and discharge the air-fuel mixture into the combustor 104, thereby causing a combustion that creates a hot pressurized exhaust gas. The combustor 100 directs the hot pressurized gas through a transition piece into a turbine nozzle (or "stage one nozzle"), and other stages of buckets and nozzles causing turbine 106 rotation. The rotation of turbine 106 causes the shaft 108 to rotate, thereby compressing the air as it flows into the compressor 102. In an embodiment, hot gas path components, including, but not limited to, shrouds, diaphragms, nozzles, buckets and transition pieces are located in the turbine 106, where hot gas flow across the components causes creep, oxidation, wear and thermal fatigue of turbine parts. Controlling the temperature of the hot gas path components can reduce distress modes in the components. The efficiency of the gas turbine increases with an increase in firing temperature in the turbine system 100. As the firing temperature increases, the hot gas path components need to be properly cooled to meet service life. Components with improved arrangements for cooling of regions proximate to the hot gas path and methods for making such components are discussed in detail below with reference to FIGS. 2 through 12. Although the following discussion primarily focuses on gas turbines, the concepts discussed are not limited to gas turbines.

Figure 2:
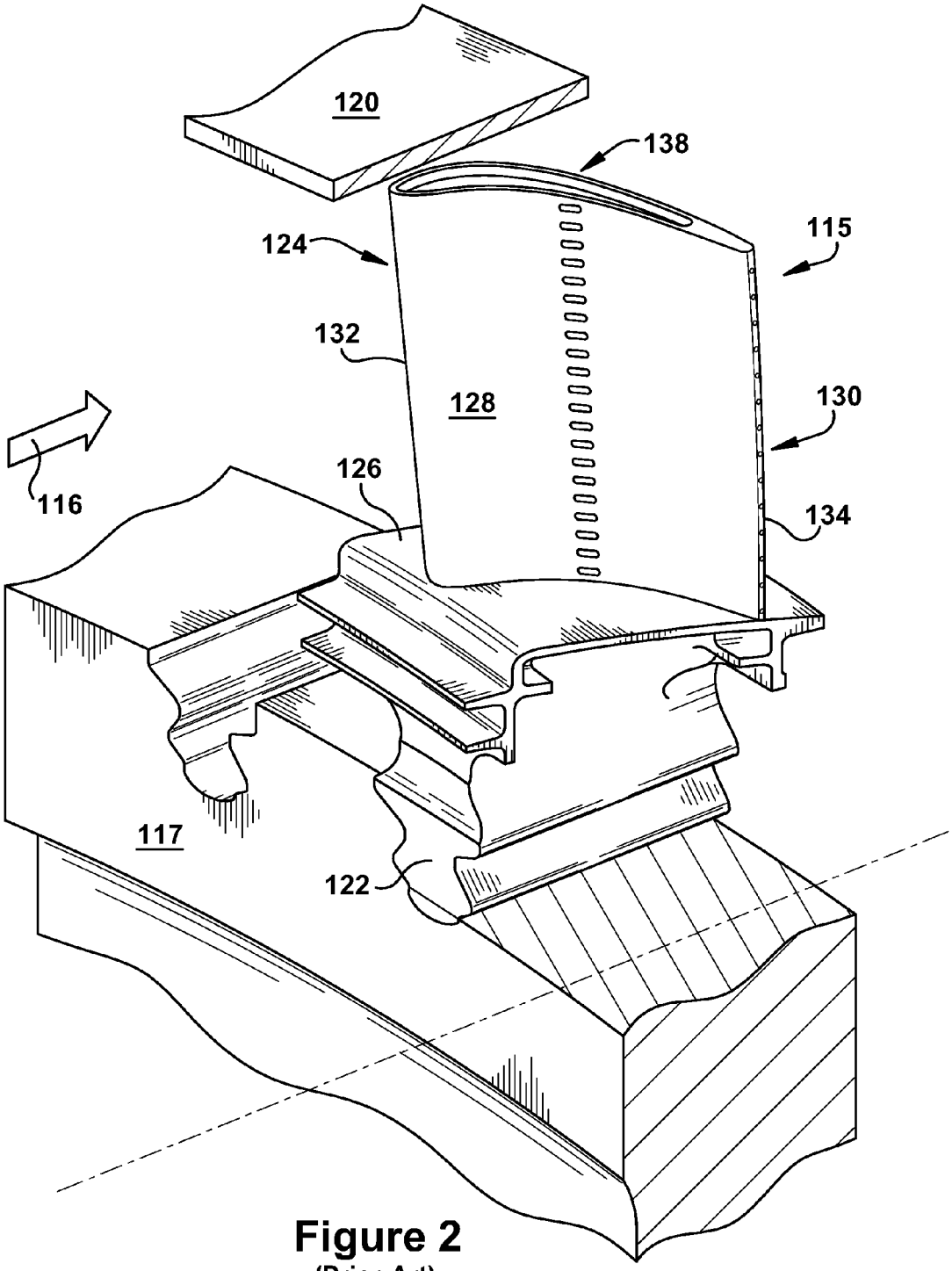
Figure 2 (Prior Art)
FIG. 2 is a perspective view of an exemplary rotor blade assembly including a rotor, a turbine blade, and a stationary shroud.

FIG. 2 is a perspective view of an exemplary hot gas path component, a turbine rotor blade 115 which is positioned in a turbine of a gas turbine or combustion engine. It will be appreciated that the turbine is mounted directly downstream from a combustor for receiving hot combustion gases 116 therefrom. The turbine, which is axisymmetrical about an axial centerline axis, includes a rotor disk 117 and a plurality of circumferentially spaced apart turbine rotor blades (only one of which is shown) extending radially outwardly from the rotor disk 117 along a radial axis. An annular turbine shroud 120 is suitably joined to a stationary stator casing (not shown) and surrounds the rotor blades 115 such that a relatively small clearance or gap remains therebetween that limits leakage of combustion gases during operation.

Each rotor blade 115 generally includes a root or dovetail 122 which may have any conventional form, such as an axial dovetail configured for being mounted in a corresponding dovetail slot in the perimeter of the rotor disk 117. A hollow airfoil 124 is integrally joined to dovetail 122 and extends radially or longitudinally outwardly therefrom. The rotor blade 115 also includes an integral platform 126 disposed at the junction of the airfoil 124 and the dovetail 122 for defining a portion of the radially inner flow path for combustion gases 116. It will be appreciated that the rotor blade 115 may be formed in any conventional manner, and is typically a one-piece casting. It will be seen that the airfoil 124 preferably includes a generally concave pressure sidewall 128 and a circumferentially or laterally opposite, generally convex suction sidewall 130 extending axially between opposite leading and trailing edges 132 and 134, respectively. The sidewalls 128 and 130 also extend in the radial direction from the platform 126 to a radially outer blade tip or tip 137.

Figure 3:
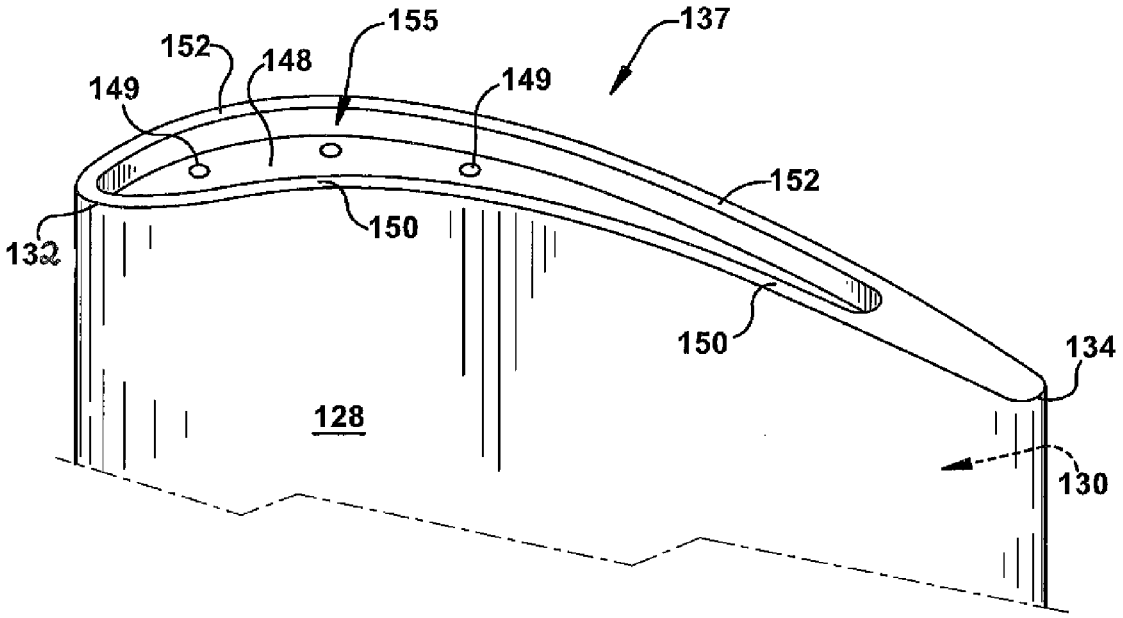
Figure 3 (Prior Art)
FIG. 3 is a perspective view of the tip of a rotor blade in which embodiments of the present application may be used.

FIG. 3 provides a close up of an exemplary blade tip 137 on which embodiments of the present invention may be employed. In general, the blade tip 137 includes a tip plate 148 disposed atop the radially outer edges of the pressure 128 and suction sidewalls 130. The tip plate 148 typically bounds internal cooling passages (which will be simply referenced herein as an "airfoil chamber") that are defined between the pressure 128 and suction sidewalls 130 of the airfoil 124. Coolant, such as compressed air bled from the compressor, may be circulated through the airfoil chamber during operation. In some cases, the tip plate 148 may include film cooling outlets 149 that release cooling during operation and promote film cooling over the surface of the rotor blade 115. The tip plate 148 may be integral to the rotor blade 115 or, as shown, a portion (which is indicated by the shaded region) may be welded/brazed into place after the blade is cast.

Due to certain performance advantages, such as reduced leakage flow, blade tips 137 frequently include a tip rail or rail 150. Coinciding with the pressure sidewall 128 and suction sidewall 130, the rail 150 may be described as including a pressure side rail 152 and a suction side rail 153, respectively. Generally, the pressure side rail 152 extends radially outwardly from the tip plate 148 (i.e., forming an angle of approximately 90°, or close thereto, with the tip plate 148) and extends from the leading edge 132 to the trailing edge 134 of the airfoil 124. As illustrated, the path of pressure side rail 152 is adjacent to or near the outer radial edge of the pressure sidewall 128 (i.e., at or near the periphery of the tip plate 148 such that it aligns with the outer radial edge of the pressure sidewall 128). Similarly, as illustrated, the suction side rail 153 extends radially outwardly from the tip plate 148 (i.e., forming an angle of approximately 90° with the tip plate 148) and extends from the leading edge 132 to the trailing edge 134 of the airfoil. The path of suction side rail 153 is adjacent to or near the outer radial edge of the suction sidewall 130 (i.e., at or near the periphery of the tip plate 148 such that it aligns with the outer radial edge of the suction sidewall 130). Both the pressure side rail 152 and the suction side rail 153 may be described as having an inner surface 157 and an outer surface 159.

Formed in this manner, it will be appreciated that the tip rail 150 defines a tip pocket or cavity 155 at the tip 137 of the rotor blade 115. As one of ordinary skill in the art will appreciate, a tip 137 configured in this manner, i.e., one having this type of cavity 155, is often referred to as a "squealer tip" or a tip having a "squealer pocket or cavity." The height and width of the pressure side rail 152 and/or the suction side rail 153 (and thus the depth of the cavity 155) may be varied depending on best performance and the size of the overall turbine assembly. It will be appreciated that the tip plate 148 forms the floor of the cavity 155 (i.e., the inner radial boundary of the cavity), the tip rail 150 forms the side walls of the cavity 155, and the cavity 155 remains open through an outer radial face, which, once installed within a turbine engine, is bordered closely by a stationary shroud 120 (see FIG. 2) that is slightly radially offset therefrom.

It will be appreciated that, within the airfoil 124, the pressure 128 and suction sidewalls 130 are spaced apart in the circumferential and axial direction over most or the entire radial span of airfoil 124 to define at least one internal airfoil chamber 156 through the airfoil 124. The airfoil chamber 156 generally channels coolant from a connection at the root of the rotor blade through the airfoil 124 so that the airfoil 124 does not overheat during operation via its exposure to the hot gas path. The coolant is typically compressed air bled from the compressor 102, which may be accomplished in a number of conventional ways. The airfoil chamber 156 may have any of a number of configurations, including, for example, serpentine flow channels with various turbulators therein for enhancing cooling air effectiveness, with cooling air being discharged through various holes positioned along the airfoil 124, such as the film cooling outlets 149 that are shown on the tip plate 148. As discussed in more detail below, it will be appreciated that such an airfoil chamber 156 may be configured or used in conjunction with surface cooling channels or microchannels of the present invention via machining or drilling a passage or connector that connects the airfoil chamber 156 to the formed surface cooling channel or microchannel. This may be done in any conventional manner. It will be appreciated that a connector of this type may be sized or configured such that a metered or desired amount of the coolant flows into the microchannel that it supplies. In addition, as discussed in more detail below, the microchannels described herein may be formed such that they intersect an existing coolant outlet (such as a film cooling outlet 149). In this manner, the microchannel may be supplied with a supply of coolant, i.e., the coolant that previously exited the rotor blade at that location is redirected such that it circulates through the microchannel and exits the rotor blade at another location.

As mentioned, one method used to cool certain areas of rotor blades and other hot gas path parts is through the usage of cooling passages formed very near and that run substantially parallel to the surface of the component. Positioned in this way, the coolant is more directly applied to the hottest portions of the component, which increases its cooling efficiency, while also preventing extreme temperatures from extending into the interior of the rotor blade. However, as one of ordinary skill in the art will recognize, these surface cooling passages—which, as stated, are referred to herein as "microchannels"—are difficult to manufacture because of their small cross-sectional flow area as well as how close they must be positioned near the surface. One method by which such microchannels may be fabricated is by casting them in the blade when the blade is formed. With this method, however, it is typically difficult to form the microchannels close enough to the surface of the component, unless very high-cost casting techniques are used. As such, formation of microchannels via casting typically limits the proximity of the microchannels to the surface of the component being cooled, which thereby limits their effectiveness. As such, other methods have been developed by which such microchannels may be formed. These other methods typically include enclosing grooves formed in the surface of the component after the casting of the component is completed, and then enclosing the grooves with some sort cover such that a hollow passageway is formed very near the surface.

One known method for doing this is to use a coating to enclose the grooves formed on the surface of the component. In this case, the formed groove is typically first filled with filler. Then, the coating is applied over the surface of the component, with the filler supporting the coating so that the grooves are enclosed by the coating, but not filled with it. Once the coating dries, the filler may be leached from the channel such that a hollow, enclosed cooling channel or microchannel is created having a desirably position very close to the component's surface. In a similar known method, the groove may be formed with a narrow neck at the surface level of the component. The neck may be narrow enough to prevent the coating from running into the groove at application without the need of first filling the groove with filler. Another known method uses a metal plate to covers the surface of the component after the grooves have been formed. That is, a plate or foil is brazed onto the surface such that the grooves formed on the surface are covered. Another type of microchannel and method for manufacturing microchannels is described in copending patent application Ser. No. 13/479,710, which, as stated, is incorporated herein. This application describes an improved microchannel configuration as well as an efficient and cost-effective method by which these surface cooling passages may be fabricated. In this case, a shallow channel or groove formed on surface of the component is enclosed with a cover wire/strip that is welded or brazed thereto. The cover wire/strip may be sized such that, when welded/brazed along its edges, the channel is tightly enclosed while remaining hollow through an inner region where coolant is routed.

The following US patent applications and patents describe with particularity ways in which such microchannels or surface cooling passages may be configured and manufactured, and are hereby incorporated in their entirety in the present application: U.S. Pat. No. 7,487,641; U.S. Pat. No. 6,528,118; U.S. Pat. No. 6,461,108; U.S. Pat. No. 7,900,458; and US Pat. App. No. 20020106457. It will be appreciated that, unless stated otherwise, the microchannels described in this application and, particularly, in the appended claims, may be formed via any of the above referenced methods or any other methods or processes known in the relevant arts.

Figure 4:
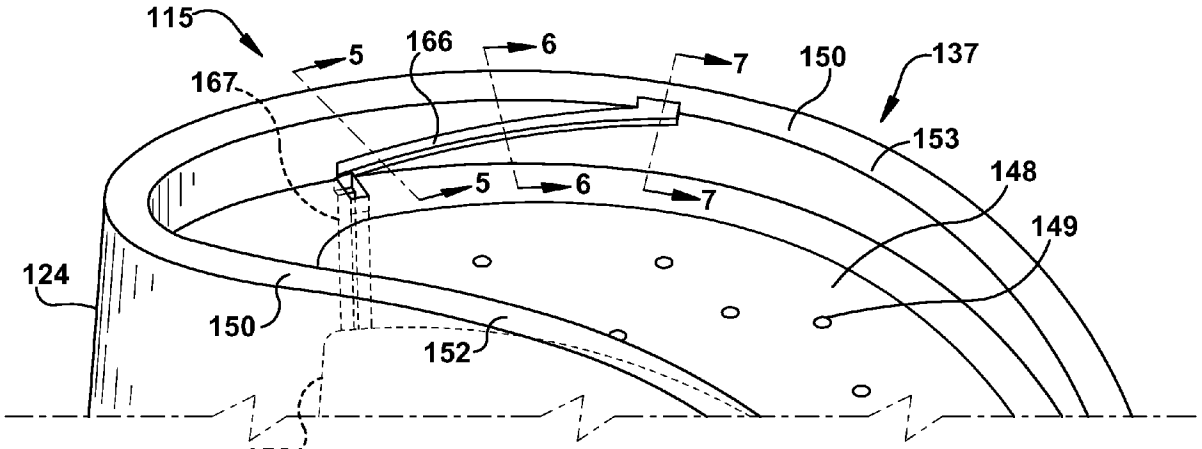
FIG. 4 is a perspective view of the tip of a rotor blade having an exemplary cooling channel according to one aspect of the present invention.

FIG. 4 is a perspective view of the inner surface of a tip rail having an exemplary surface cooling channel or microchannel (hereinafter "microchannel 166") according to a preferred embodiment of the present invention. It will be appreciated that FIG. 4 illustrates an unenclosed or uncovered microchannel 166 that is formed on the inner rail surface 157. More precisely, the microchannel 166 is formed along the suction side rail 153, toward the leading edge 132 of the airfoil 124, though any position along the rail 150 is also possible. Being uncovered, the microchannel 166 resembles a narrow and shallow groove that is cut or machined into the surface of the rotor blade 115. The cross-sectional profile of the groove may be rectangular or circular, though other shapes are also possible. As illustrated, in a preferred embodiment, the microchannel 166 has an upstream side positioned at the base of the rail 150 and a downstream side positioned near the outboard edge or surface of the rail 150. The upstream side of the microchannel 166 may be positioned at the rail 150 so that it may conveniently be connected to a connector 167 that is formed at this location. It will be appreciated that the connector 167 may be an internal passageway that extends between the upstream side of the microchannel 166 and an internal coolant source, which in this case is the airfoil chamber 156.

Extending from a position near the base of the rail 150, it will be appreciated that the microchannel 166 may approximately form an angle with the tip plate 148. In certain preferred embodiments, the angle is between 5° and 40°, though other configurations are also possible. Being canted in this manner, it will be appreciated that the microchannel 168 may increase the area of rail 150 it cools. The microchannel 166 may be linear, as illustrated. In alternative embodiments, the microchannel 166 may be curved or slightly curved.

Figure 7:
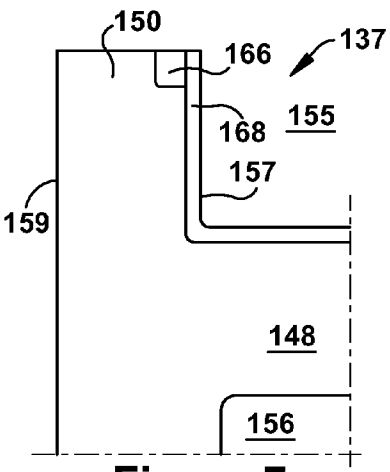
FIG. 7 is a section view along 7-7 of the exemplary embodiment of FIG. 4.
Figure 6:
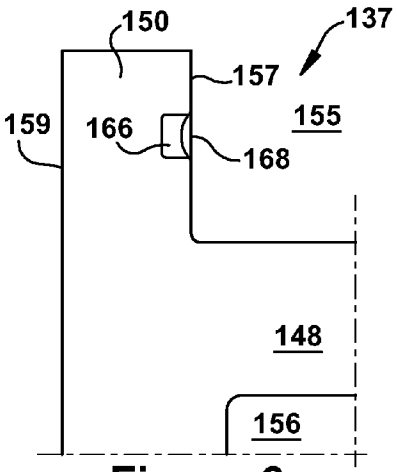
FIG. 6 is a section view along 6-6 of the exemplary embodiment of FIG. 4.
Figure 5:
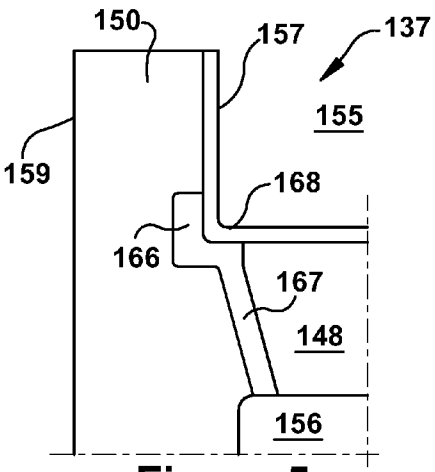
FIG. 5 is a section view along 5-5 of the exemplary embodiment of FIG. 4.

FIGS. 5 through 7 provide section views along the noted cuts in FIG. 4. It will be appreciated that in FIG. 4, the channel cover or cover 168 is omitted, which is done so that the microchannel 166 is shown more clearly. In FIGS. 5 through 7, exemplary channel covers 168 are provided. FIG. 5 is a section view along 5-5 of the exemplary embodiment of FIG. 4. In FIG. 5, a coating is used to enclose the groove such that the microchannel 166 is formed. The coating may be any suitable coating for this purpose, including an environmental barrier coating. FIG. 6 is a section view along 6-6 of the exemplary embodiment of FIG. 4. In FIG. 6, a welded/brazed machined wire/strip is used to enclose the machined groove such that the microchannel 166 is formed (as process described in the above referenced, co-pending application, Ser. No. 13/479,710). FIG. 7 is a section view along 7-7 of the exemplary embodiment of FIG. 4. In FIG. 7, a solid plate is as the cover 168. In this case, the solid plate is affixed to the rail 150 and the tip plate 148 to enclose the groove such that the microchannel 166 is formed. Other cover methods may be utilized as needed.

It will be appreciated that FIGS. 4 through 7 illustrate a microchannel configuration that may be efficiently added to existing rotor blades. That is, existing rotor blades may be conveniently retrofitted with microchannels 166 of this type to address hotspots that are known or determined to exist in the rail 150 during operation or, as discussed below, in the tip plate 148. To achieve this, a groove may be machined in the inner surface 157 of the rail 150. The machining may be completed by any known process. The groove may be connected to a coolant source via a machined passageway through the tip plate 148, which is referred to as connector 167. Then a cover 168 may be used to enclose the groove such that a functioning microchannel 166 is created, which may be specifically disposed to address a hotspot.

In certain preferred embodiments, a microchannel 166 is defined herein to be an enclosed restricted internal passageway that extends very near and approximately parallel to an exposed outer surface of the rotor blade. In certain preferred embodiments, and as used herein where indicated, a microchannel 166 is a coolant channel that is positioned less than about 0.050 inches from the outer surface of the rotor blade, which, depending on how the microchannel 166 is formed, may correspond to the thickness of the channel cover 168 and any coating that encloses the microchannel 166. More preferably, such a microchannel resides between 0.040 and 0.020 inches from the outer surface of the rotor blade.

In addition, the cross-sectional flow area is typically restricted in such a microchannel, which allows for the formation of numerous microchannels over the surface of a component, and the more efficient usage of coolant. In certain preferred embodiments, and as used herein where indicated, a microchannel 166 is defined as having a cross-sectional flow area of less than about 0.0036 inches$^2$. More preferably, such microchannels have a cross-sectional flow area between about 0.0025 and 0.009 inches$^2$. In certain preferred embodiments, the average height of a microchannel 166 is between about 0.020 and 0.060 inches, and the average width of a microchannel 166 is between about 0.020 and 0.060 inches.

Figure 8:
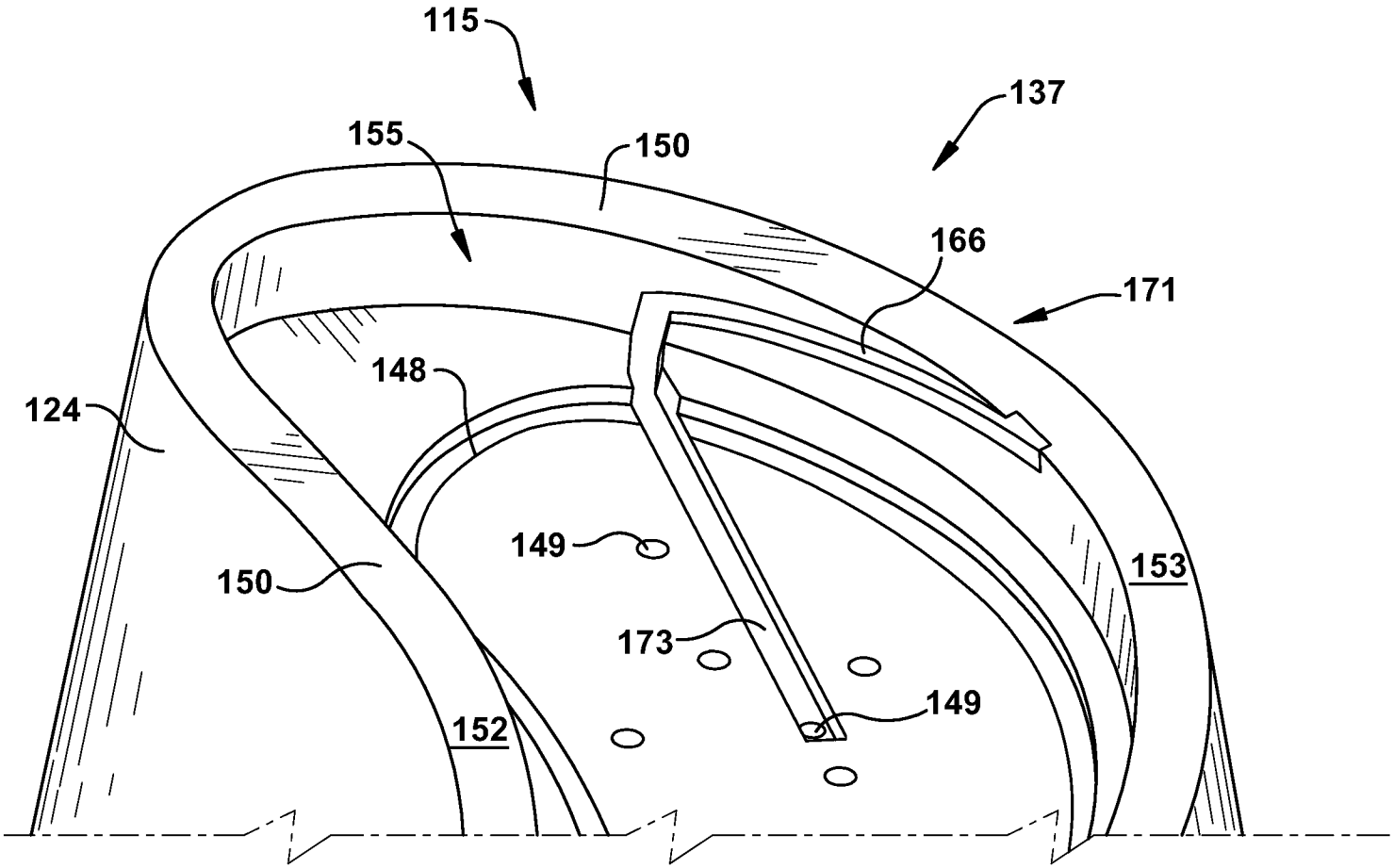
FIG. 8 is a perspective view of the tip of a rotor blade having an exemplary cooling channel according to another aspect of the present invention.
Figure 9:
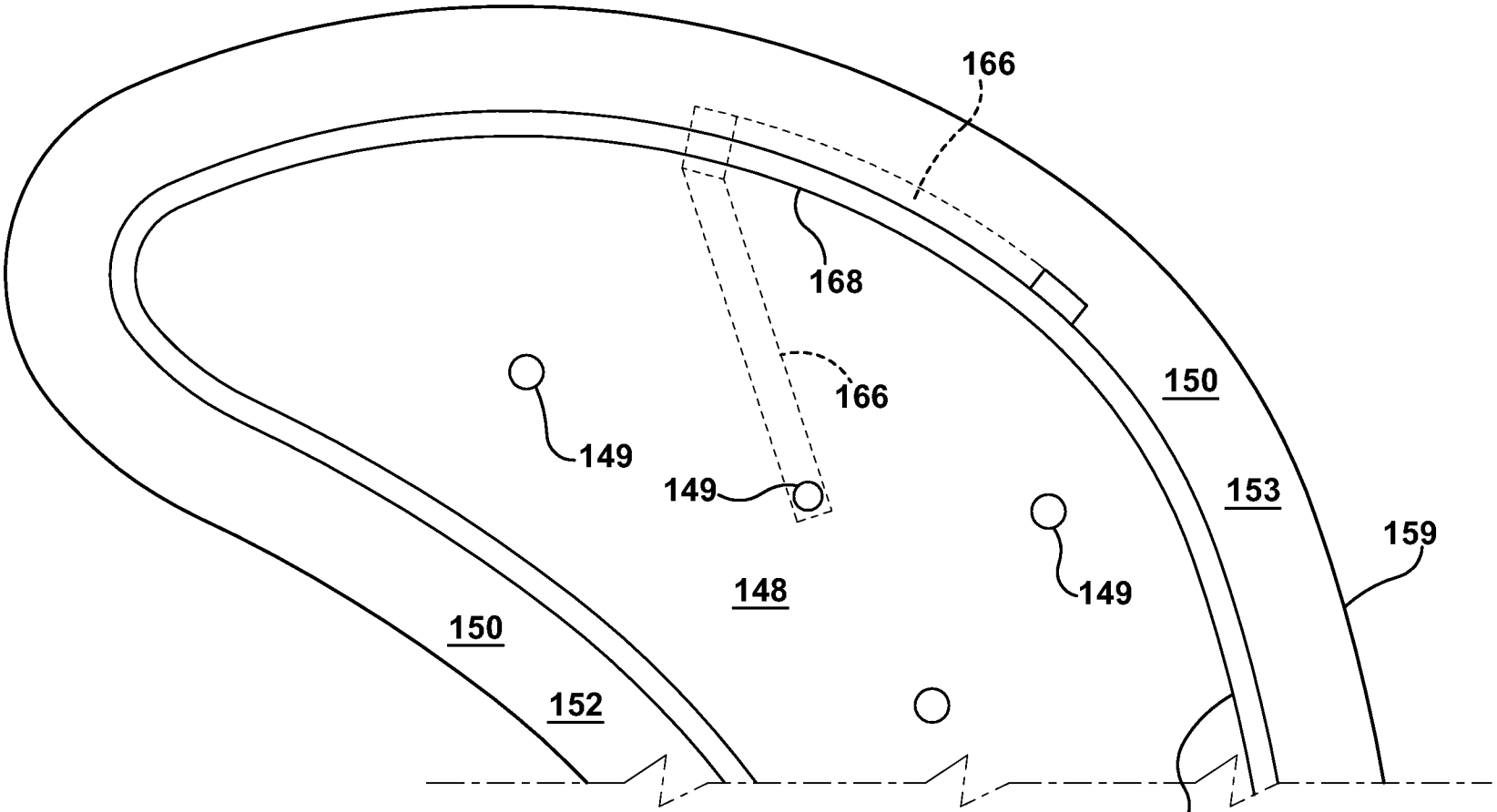
FIG. 9 is a top view of the tip of a rotor blade having an exemplary cooling channel according to another aspect of the present invention.

FIG. 8 is a perspective view of a rotor blade tip 137 having an exemplary microchannel 166 according to another aspect of the present invention. In this case, the microchannel 166 is supplied via an existing film coolant outlet 149 instead of a connector 167. FIG. 9 is a top view of the same rotor blade tip 137 as shown in FIG. 8. It will be appreciated that in FIG. 8 (like in FIG. 4) the cover 168 is not shown. Instead, FIG. 8 shows two connecting grooves: a first groove 171 formed in the rail 150 that is similar to the groove shown in FIG. 4; and a second groove 173 formed in the tip plate 148 that connects to the first groove 171. At an upstream side, the second groove 173 may intersect an existing film cooling outlet 149. It will be appreciated that, in an alternative embodiment, a connector 167 could also be machined through the tip plate 148 at this location as a coolant supply. The second groove 173 may extend toward an upstream end of the first groove 171 and make a connection therewith, as illustrated. The first groove 171 may extend toward a downstream end positioned near the outboard edge of the rail 150. The downstream end of the first groove may remain open such that an outlet for the coolant is created.

FIG. 9 provides a top view of the tip 137 of FIG. 8 after a coating is applied. The coating, as stated, may enclose the first and second grooves 171, 173, thereby acting as the aforementioned channel cover 168. In this manner, the first and second groove 171, 173 are enclosed such that functioning microchannels 166 are formed. Using this type of configuration, a known hot-spot on either the tip plate 148 or the rail 150 may be addressed. In addition, given the efficiency of microchannel cooling, these known hotspots may be addressed with a reduced or minimized amount of coolant when compared with, for example, a film cooling approach. As depicted, the microchannel 166 also may be supplied via an existing coolant outlet, which would eliminate the need of machining a new passageway to connect the microchannel to a coolant supply.

Figure 10:
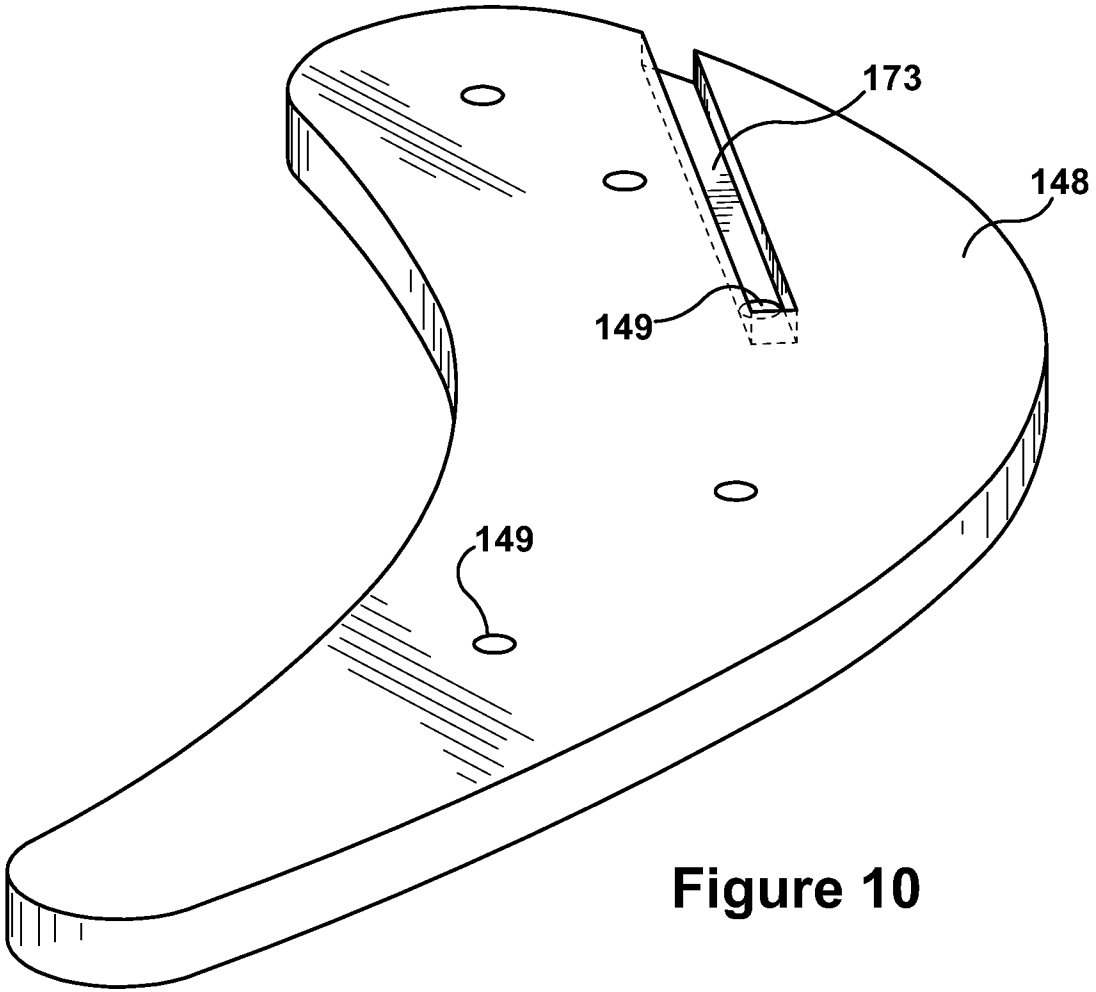
FIG. 10 is a perspective view of the tip plate of a rotor blade having an exemplary cooling channel according to another aspect of the present invention.

FIG. 10 is a perspective view of a tip plate 148 of a rotor blade having an exemplary cooling channel (i.e., second grove 173) according to another aspect of the present invention. In some instances, a tip plate 148 (or a portion thereof) may include a non-integral component like the one shown. In such cases, the tip plate 148 may be machined separate from the rotor blade 115 such that once installed, the second groove 173 aligns with the continuation of the second groove which is formed on the integral portions of the tip plate 148 or a channel on the inner surface of the rail 150. Specifically, if the tip plate 148 is separately attached afterwards, the tip plate 148 could be pre-machined (and also pre-covered) as an initial step and then attached either to a new rotor blade or as a retrofit.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A turbine rotor blade for a gas turbine engine, the turbine rotor blade comprising:

an airfoil having a tip at an outer radial edge;

wherein:

the airfoil includes a pressure sidewall and a suction sidewall that join together at a leading edge and a trailing edge of the airfoil, the pressure sidewall and the suction sidewall extending from a root to the tip;

the tip includes a tip plate and, disposed along a periphery of the tip plate, a rail; and the rail includes a rail microchannel connected to a coolant source;

the tip plate includes a tip plate microchannel disposed on the tip plate, the tip plate microchannel comprising an upstream end and a downstream end;

wherein the downstream end of the tip plate microchannel connects to an upstream end of the rail microchannel at the base of the rail; and wherein a downstream end of the rail microchannel is positioned near an outer radial edge of the rail.

2. The turbine rotor blade according to claim 1, wherein the pressure sidewall comprises an outer radial edge and the suction sidewall comprises an outer radial edge, the airfoil being configured such that the tip plate extends axially and circumferentially to connect the outer radial edge of the suction sidewall to the outer radial edge of the pressure sidewall.

3. The turbine rotor blade according to claim 2, wherein the rail includes a pressure side rail and a suction side rail, the pressure side rail connecting to the suction side rail at the leading edge and the trailing edge of the airfoil;

wherein the pressure side rail extends radially outward from the tip plate, traversing from the leading edge to the trailing edge such that the pressure side rail approximately aligns with the outer radial edge of the pressure sidewall; and wherein the suction side rail extends radially outward from the tip plate, traversing from the leading edge to the trailing edge such that the suction side rail approximately aligns with the outer radial edge of the suction sidewall.

4. The turbine rotor blade according to claim 3, wherein the pressure side rail and the suction side rail are continuous between the leading edge to the trailing edge of the airfoil, and defined a tip cavity therebetween.

5. The turbine rotor blade according to claim 3, wherein the rail microchannel is disposed on an inner rail surface of the rail.

6. The turbine rotor blade according to claim 5, wherein the rail microchannel is disposed on the suction side rail.

7. The turbine rotor blade according to claim 5, wherein the rail microchannel is disposed on the pressure side rail.

8. The turbine rotor blade according to claim 5, wherein the rail microchannel comprises a non-integral cover which encloses a machined groove.

9. The turbine rotor blade according to claim 8, wherein the cover comprises one of a coating, a sheet, foil, and a wire.

10. The turbine rotor blade according to claim 5, wherein the rail microchannel is disposed to traverse through an area on the rail that is a known hotspot.

11. The turbine rotor blade according to claim 5, wherein the rail microchannel comprises an enclosed hollow passageway that extends near and approximately parallel to an outer surface of the tip of the rotor blade.

12. The turbine rotor blade according to claim 11, wherein the rail microchannel resides less than about 0.05 inches from the inner rail surface.

13. The turbine rotor blade according to claim 12, wherein the rail microchannel comprises a cross-sectional flow area of less than about 0.0036 inches$^2$.

14. The turbine rotor blade according to claim 12, wherein the rail microchannel comprises an average height of between 0.02 and 0.06 inches and an average width of between 0.02 and 0.06 inches.

15. The turbine rotor blade of claim 11, wherein the rail microchannel resides between about 0.04 and 0.02 inches from the inner rail surface;

wherein the rail microchannel comprises a cross-sectional flow area of between about 0.0025 and 0.0009 inches$^2$; and wherein the rail microchannel comprises an average height of between 0.02 and 0.06 inches and an average width of between 0.02 and 0.06 inches.

16. The turbine rotor blade according to claim 1, wherein the airfoil comprises an airfoil chamber, the airfoil chamber comprising an internal chamber configured to circulate a coolant during operation.

17. The turbine rotor blade according to claim 16, wherein the downstream end of the rail microchannel comprises an outlet.

18. The turbine rotor blade according to claim 1, wherein the rail microchannel forms an angle with the tip plate, wherein the angle is between 5° and 40°.

19. The turbine rotor blade according to claim 1, wherein the rail microchannel is linear.

20. The turbine rotor blade according to claim 5, wherein the upstream end of the tip plate microchannel connects to a coolant passageway that passes through the tip plate to an airfoil chamber.

21. The turbine rotor blade according to claim 20, wherein the coolant passageway through the tip plate comprises a film coolant outlet;

wherein the tip plate microchannel is configured to direct the coolant that would have exited the turbine blade from the film coolant outlet through the tip plate microchannel;

wherein the connection between the tip plate microchannel and the rail microchannel is configured to direct the coolant flowing through the tip plate microchannel through the rail microchannel; and wherein the cooling flowing through the rail microchannel flows from the upstream end to an outlet located at the downstream end, the outlet being disposed near an outer radial edge of the rail.

* * * * *